US005990630A

United States Patent [19]

Nakamura

[11] Patent Number: 5,990,630

[45] Date of Patent: Nov. 23, 1999

[54] METHOD FOR CONTROLLING SURFACE DISCHARGE ALTERNATING CURRENT PLASMA DISPLAY PANEL WITH DRIVERS PERIODICALLY CHANGING DUTY FACTOR OF DATA PULSES

[75] Inventor: Tadashi Nakamura, Tokyo, Japan

[73] Assignee: NEC Corporation, Tokyo, Japan

[21] Appl. No.: 09/003,162

[22] Filed: Jan. 6, 1998

[30] Foreign Application Priority Data

Jan. 10, 1997 [JP] Japan ..... 9-003108

[51] Int. Cl.[6] ..... G09G 3/10

[52] U.S. Cl. ..... 315/169.4; 315/169.1; 345/60; 345/67; 345/68

[58] Field of Search ..... 315/169.4, 169.1, 315/169.2, 291; 345/60, 61, 67, 68

[56] References Cited

U.S. PATENT DOCUMENTS

| | | | |
|---|---|---|---|
| 4,006,298 | 2/1977 | Fowler et al. | 348/798 |
| 5,155,414 | 10/1992 | Sano | 315/169.4 |
| 5,436,634 | 7/1995 | Kanazawa | 345/67 |
| 5,654,728 | 8/1997 | Kanazawa et al. | 345/68 |
| 5,684,499 | 11/1997 | Shimizu et al. | 345/60 |
| 5,739,641 | 4/1998 | Nakamura et al. | 315/169.1 |

FOREIGN PATENT DOCUMENTS

| | | |
|---|---|---|
| 2-29779 | 1/1990 | Japan . |
| 6-4039 | 1/1994 | Japan . |
| 7-64508 | 3/1995 | Japan . |
| 7-319424 | 12/1995 | Japan . |
| 8-305319 | 11/1996 | Japan . |

OTHER PUBLICATIONS

T. Nakamura et al., "Drive for 40–In.–Diagonal Full–Color ac Plasma Display", *SID 95 Digest*, 1995, pp. 807–810.

Patent Abstracts of Japan; vol. 97, No. 3, Mar. 31, 1997 & JP 08305319 A (NEC Corp.), Nov. 22, 1996, Abstract.

Patent Abstracts of Japan; vol. 17, No. 323 (P–1559), Jun. 18, 1993 & JP 05035206 A (Fujitsu Ltd.), Feb. 12, 1993, Abstract.

Patent Abstracts of Japan; vol. 96, No. 1, Jan. 31, 1996 & JP 07248744 A (Fujitsu General Ltd.), Sep. 26, 1995, Abstract.

*Primary Examiner*—Haissa Philogene

*Attorney, Agent, or Firm*—Sughrue, Mion, Zinn, Macpeak & Seas, PLLC

[57] ABSTRACT

A surface discharge alternating current plasma display panel selects pixels to be fired by applying a scanning pulse and a data pulse to scanning electrodes and data electrodes, and the data electrodes are divided into a plurality of data electrode groups supplied with data pulses different in duty factor; when a data pulse with a large duty factor is applied to one of the data electrode group, the data pulse with the large duty factor is applied to another data electrode group so as to equalize the load of drivers connected to the data electrode groups.

6 Claims, 11 Drawing Sheets

METHOD FOR CONTROLLING SURFACE DISCHARGE ALTERNATING CURRENT PLASMA DISPLAY PANEL WITH DRIVERS PERIODICALLY CHANGING DUTY FACTOR OF DATA PULSES

FIELD OF THE INVENTION

This invention relates to an alternating current plasma display panel and, more particularly, to a method for controlling a surface discharge alternating current plasma display panel.

DESCRIPTION OF THE RELATED ART

The plasma display panel has various attractive features such as a self-light emitting thin structure, a prompt response and a wide screen for producing a full-color large contrast image without flicker. These features are desirable for an interface between a computer and an operator.

The plasma display panel is broken down into two categories. The first category is an alternating current plasma display panel, which has electrodes covered with dielectric material so as to indirectly discharge electric charges under application of alternating current. The second category is direct current plasma display panel, which has electrodes exposed to discharging space so as to produce direct discharge. The alternating current plasma display panel is further broken down into two sub-categories, i.e., a pulse memory driving type alternating current plasma display panel and a refresh type alternating current plasma display panel.

The luminance of the alternating current plasma display panel is proportional to the number of discharges or the repetition of pulses applied to the electrodes. The refresh type alternating current plasma display panel decreases the luminescence inversely proportional to the display area, and, for this reason, is appropriate for a small image producing apparatus.

FIG. 1 illustrates the structure of a pixel incorporated in the prior art pulse memory driving type alternating current plasma display panel. The pixel comprises a back substrate structure 1 and a front substrate structure 2, and a partition wall 3 spaces the back substrate surface 1 from the front substrate 2. Discharging gas 4 such as helium, neon, xenon or gaseous mixture thereof fills the space between the back substrate structure 1 and the front substrate structure 2. The discharging gas generates ultra-violet light during discharging.

The back substrate structure 1 includes a transparent glass plate 1*a*, and a data electrode 1*b* is formed on the transparent glass plate 1*a*. The data electrode 1*b* is covered with a dielectric layer 1*c*, and a phosphor layer 1*d* is laminated on the dielectric layer 1*c*. The ultra-violet light is radiated onto the phosphor layer 1*d*, and the phosphor layer 1*d* converts the ultra-violet light to visible light. The visible light is radiated as indicated by arrow AR1.

The front substrate structure 2 includes a transparent glass plate 2*a*, and a scanning electrode 2*b* and a sustain electrode 2*c* are formed on the transparent glass plate 2*a*. The scanning electrode 2*b* and the sustain electrode 2*c* extend in the perpendicular direction to the data electrode 1*b*. Trace electrodes 2*d*/2*e* are laminated on the scanning electrode 2*b* and the sustain electrode 2*c*, respectively, and are expected to reduce the resistance against a scanning signal and a sustain signal. These electrodes 2*b*, 2*c*, 2*d* and 2*e* are covered with a dielectric layer 2*f*, and the dielectric layer 2*f* is overlain by a protective layer 2*g*. The protective layer 2*g* is formed of magnesium oxide, and prevents the dielectric layer 2*f* from the discharge.

The prior art pixel shown in FIG. 1 produces a piece of image as follows. Firstly, initial potential larger than the discharging threshold is applied between the scanning electrode 2*b* and the data electrode 1*b*, and discharging take place therebetween. Positive charge and negative charge are attracted toward the dielectric layers 2*f*/1*c* over the scanning electrode 2*b* and the data electrode 1*b*, and are accumulated thereon as wall charges. The wall charges produce potential barriers, and gradually decrease the effective potential. For this reason, even if the initial potential is maintained between the scanning electrode 2*b* and the data electrode 1*b*, the prior art pixel stops the discharge.

Thereafter, a sustain pulse is applied between the scanning electrode 2*b* and the sustain electrode 2*c*, and is identical in polarity with the wall potential. The wall potential is superposed on the sustain pulse. For this reason, even though the amplitude of the sustain pulse is low, the potential exceeds over the discharging threshold, and continues the discharging. Thus, while the sustain pulse is being applied between the scanning electrode 2*b* and the sustain electrode 2*c*, the sustain discharging is continued. This is the memory function.

When an erase pulse is applied between the scanning pulse 2*b* and the sustain pulse 2*c*, the wall potential is canceled, and the pixel stops the sustain discharge. The erase pulse has wide pulse width and low amplitude or narrow width.

FIG. 2 illustrates the layout of pixels incorporated in the pulse memory driving type alternating current plasma display panel. The pixels 5 are identical in structure with the prior art pixel shown in FIG. 1, and form a display area 6. The pixels 5 are arranged in j rows and k columns, and a small box stands for each pixel 5 in FIG. 2. Scanning electrodes Sc1 to Scj and sustain electrodes Su1 to Suj extend in the direction of rows, and the scanning electrodes Sc1 to Scj are respectively paired with the sustain electrodes Su1 to Suj. The pairs of scanning/sustain electrodes Sc1/Su1 to Scj/Suj are respectively associated with the rows of pixels 5. On the other hand, data electrodes extend in the direction of columns, and are associated with the columns of pixels 5, respectively.

FIG. 3 illustrates the prior art method for controlling the alternating current plasma display panel shown in FIG. 2, and the prior art method is disclosed by Nakamura et al in "Drive for 40-in.-Diagonal Full Color ac Plasma Display", Society for Information Display International Symposium Digest of Technical Papers, volume XXVI, pages 807 to 810. Priming discharge period A, write-in period B and sustain discharge period C form each field, and a driving cycle or a frame has field 1 and field 2. A sustain electrode driving signal Wu is supplied to all the sustain electrodes Su1 to Suj, and scanning electrode4 driving signals Ws1, Ws2 . . . Wsj are respectively supplied to the scanning electrodes Sc1 to Scj. A data electrode driving signal Wd is selectively supplied to the data electrodes D1 to Dk.

Active particles and the wall charges are produced in the priming discharge period A so as to obtain stable write-in discharge characteristics. The priming discharge pulse Pp is applied to all the sustain electrodes Su1 to Suj, and causes the priming discharge to take place in all the pixels 5. The priming discharge produces the wall charges. In order to erase the wall charge undesirable for the sustain charge, an erase pulse Ppe is concurrently supplied to the scanning electrodes Sc1 to Scj.

In the write-in period B, the scanning pulse Pw is sequentially supplied to the scanning electrodes Ws1 to Wsj, and a data pulse Pd is selectively supplied to the data electrodes D1 to Dk associated with the pixels to emit the visible light in synchronism with the scanning pulse Pw. Then, write-in discharge takes place in the pixels 5 to emit the visible light, and the wall charge is produced for the pixels 5. The data pulse Pd is concurrently applied to all the data electrode D1 to Dk, and the photo-emitting current starts to flow at respective timings when both scanning and data pulses Pw/Pd take place between the scanning electrodes Sc2 to Scj and the data electrodes D1 to Dk.

In the sustain discharge period C, a sustain pulse Pc is supplied to the sustain electrodes Su1 to Suj, and, another sustain pulse Ps is supplied to the scanning electrodes Sc1 to Scj. The sustain pulse Ps is different in phase from the sustain pulse Pc at 180 degrees. The sustain pulses Pc/Ps maintains the luminance of the pixels 5 selected in the write-in period B.

As described hereinbefore, the plasma display panel is appropriate for a wide display area. The plasma display panel produces an image through gas discharge in the pixels, and requires a large amount of photo-emitting current for the gas discharge. If the potential difference is low due to large output impedance of driving circuits and large resistance of the electrodes Sc1–Scj and D1 to Dk, the potential range for the pulses is tight, and the illuminance is decreased. Especially, when a large number of pixels 5 are selected from the display area 6 in the write-in period B, the pixels 5 require a large amount of current for the gas discharge. However, the output impedance of the drivers and the resistance of the scanning electrodes Sc2 to Scj strongly affect the amount of current, and the pulse height tends to be decreased. In this situation, the driver is expected to increase the pulse height of the data pulse Pd, or the designer is required to decrease the output impedance of the driver for the scanning electrodes Sc1 to Scj.

When the pixels 5 are increased for a wide display area 6, the data electrodes are prolonged, and the parasitic capacitance coupled to each electrode is increased. Moreover, the pulses are driven at higher frequency. This results in heavy load to be driven by the driver and, accordingly, a large amount of electric power consumption. In short, the plasma display panel requires strong drivers for a wide display area 6, and the strong drivers increase the production cost. The reduction of output impedance also results in expensive drivers, and the expensive drivers increase the production cost.

Though not shown in FIG. 2, the driver is incorporated in the prior art plasma display panel for the data electrodes D1 to Dk, and is expected to drive all the data electrodes D1 to Dk. The load of the driver is proportionally increased together with the resolution and the display area.

FIG. 4 illustrates relation between the minimum potential of the data pulse Pd required for the write-in discharge and the image data per each scanning electrode. If the pixels to be fired are equal to or less than 50 percent, the minimum potential is substantially constant. However, when the pixels to be fired exceed 50 percent, the minimum potential is increased as indicated by plots PL1. The driver lifts the potential level of the data electrodes D1 to Dk to or over the minimum potential at 100 percent. If the data electrodes D1 to Dk are lower than the minimum potential level, some pixels are misfired, and misfired pixels deteriorate the image produced on the display area 6. For this reason, the driver is expected to stably drive the data electrodes D1 to Dk, and the strong driver is expensive.

FIG. 5 illustrates another prior art surface discharge alternating current plasma display panel disclosed in Japanese Patent Publication of Unexamined Application No. 8-305319. Small circles stand for pixels 7, respectively. The pixels 7 are arranged in rows and columns, and form a display area 8. The rows of pixels 7 are respectively associated with scanning electrodes Sc1 to Scj and sustain electrodes Su1 to Suj, and the columns of pixels 7 are associated with data electrodes D1 to Dg and Dg+1 to D2g. The data electrodes D1 to Dg and Dg+1 to D2g are divided into two data groups G1 and G2.

FIG. 6 illustrates the prior art method for controlling the alternating current plasma display panel shown in FIG. 5. Iw1 to Iwj stand for discharge current flowing through the scanning electrodes Sc2 to Scj, respectively. In the write-in period, a data pulse Pda is applied to the data electrodes D1 to Dg, and a data pulse Pdb is applied to the data electrodes Dg+1 to D2g. Time delay is introduced between the data pulse Pda and the data pulse Pdb, and is 400 nanosecond in the prior art alternating current plasma display panel. For this reason, the discharge current Iw1 to Iwj have two peaks, and the peak current is smaller than the peak current of the prior art alternating current plasma display panel shown in FIG. 2.

The prior art method shown in FIG. 6 allows the manufacturer to decrease the peak current, and makes the potential drop due to the output impedance of the driver and the resistance of the electrodes. Moreover, the data pulse Pda is equal in pulse width to the scanning pulse Pw. If the driver successively supplies the data pulse Pda to the data electrodes adjacent to each other, the driver does not recover the data pulse Pw to zero. The driver pulls down the data pulse Pda to a certain level, and raises the data pulse Pda from the certain level. For this reason, the power consumption is relatively small for the data pulse Pda.

On the other hand, the data pulse Pdb is supplied to the data electrodes Dg+1 to D2g at intervals. The driver is expected to recover the data pulse Pdb to zero between the data pulses Pdb, and is expected to fully swing the data pulse Pdb. This results in a large amount of power consumption.

Thus, the driver for the data pulse Pdb is expected to drive the load heavier than that of the driver for the data pulse Pda, and the driver for the data pulse Pdb tends to be heated higher than the other driver for the data pulse Pdb.

SUMMARY OF THE INVENTION

It is therefore an important object of the present invention to provide a method for controlling an alternating current plasma display panel which eliminates the unbalance from drivers for data electrodes without increase of peak current.

To accomplish the object, the present invention proposes to change the order of data pulses.

In accordance with one aspect of the present invention, there is provided a method for controlling a plasma display panel having a plurality of scanning electrodes, a plurality of sustain electrodes respectively paired with the plurality of scanning electrodes for forming a plurality of electrode pairs, a plurality of data electrodes divided into a plurality of data electrode groups and a plurality of pixels selectively associated with the plurality of electrode pairs and the plurality of data electrodes and selectively fired for forming an image, and the method comprises the steps of a) supplying a scanning pulse and a plurality of data pulses different in duty factor and delayed from one another sequentially to the scanning electrodes and selectively to said plurality of data electrodes of said plurality of data electrode groups in a first phase of a certain field, respectively, for selectively generating a write-in discharge in the plurality of pixels, b) supplying a first sustain pulse and a second sustain pulse different in phase from the first sustain pulse to the plurality of scanning electrodes and the plurality of sustain electrodes in a second phase of the certain field for keeping the first certain pixels fired, c) supplying the scanning pulse and the plurality of data pulses changed in duty factor from the plurality of data pulses in step a) sequentially to the scanning electrodes and selectively to the plurality of data electrodes of the plurality of data electrode groups in the first phase of another field, respectively, for selectively generating the write-in discharge in the plurality of pixels, and d) supplying the first sustain pulse and the second sustain pulse to the plurality of scanning electrodes and the plurality of sustain electrodes in the second phase of the aforesaid another field for keeping the second certain pixels fired.

BRIEF DESCRIPTION OF THE DRAWINGS

The features and advantages of the method for controlling an alternating current plasma display panel will be more clearly understood from the following description taken in conjunction with the accompanying drawings in which.

DESCRIPTION OF THE PREFERRED EMBODIMENTS

FIRST EMBODIMENT

Figure 1:
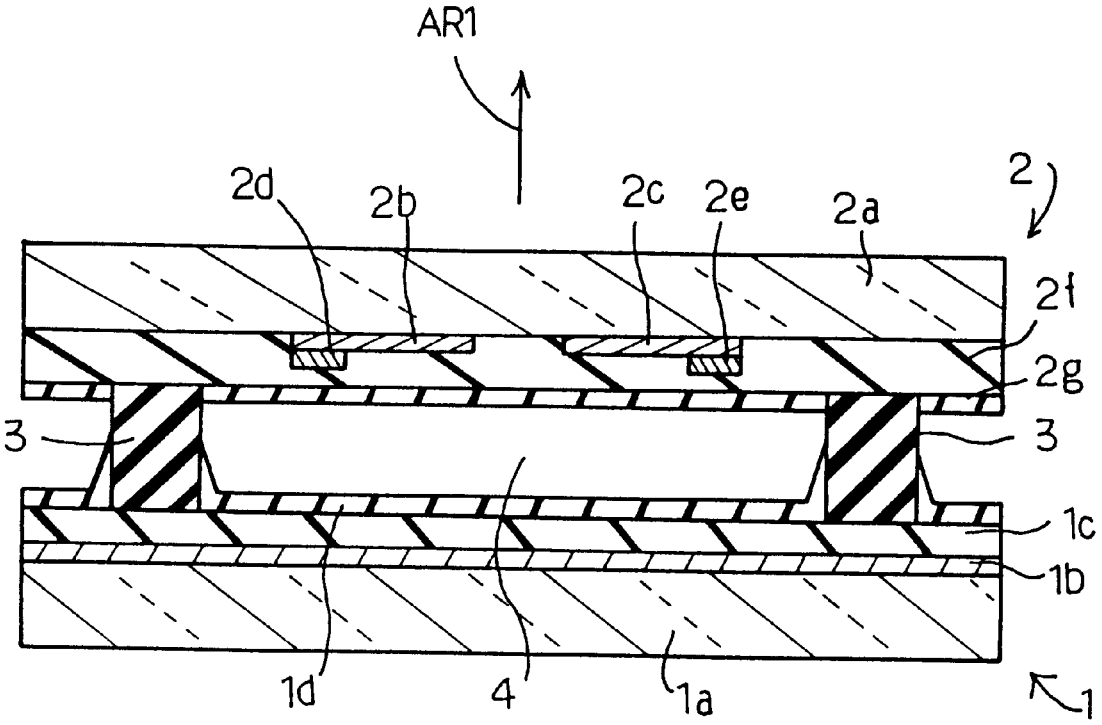
Fig. 1 PRIOR ART
FIG. 1 is a cross sectional view showing the structure of the prior art pixel.
Figure 2:
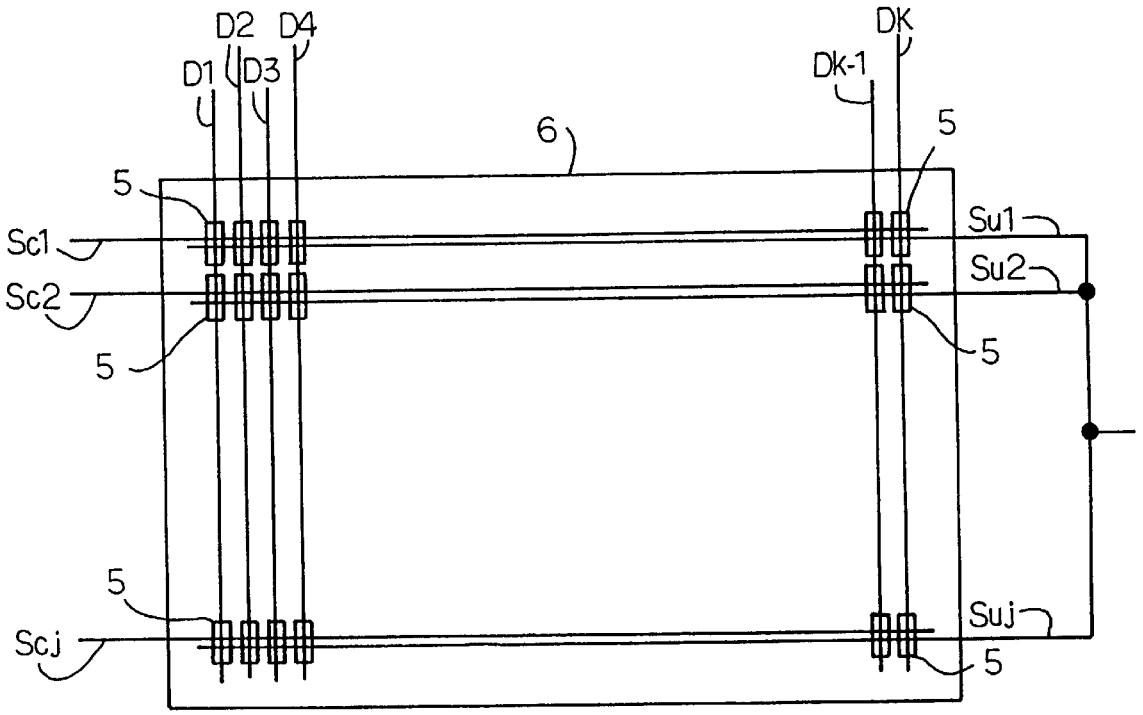
Fig. 2 PRIOR ART
FIG. 2 is a plan view showing the layout of the pixels and the electrodes incorporated in the prior art pulse memory driving type alternating current plasma display panel.
Figure 3:
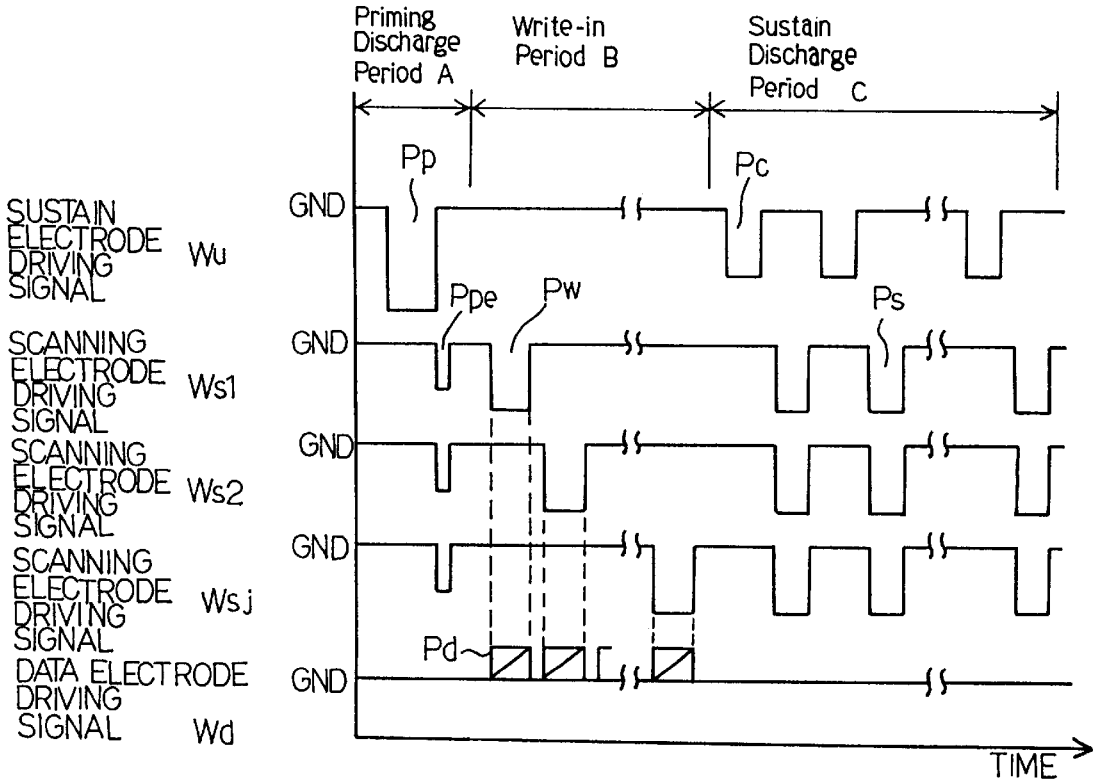
Fig. 3 PRIOR ART
FIG. 3 is a timing charge showing the prior art method for controlling the alternating current plasma display panel.
Figure 4:
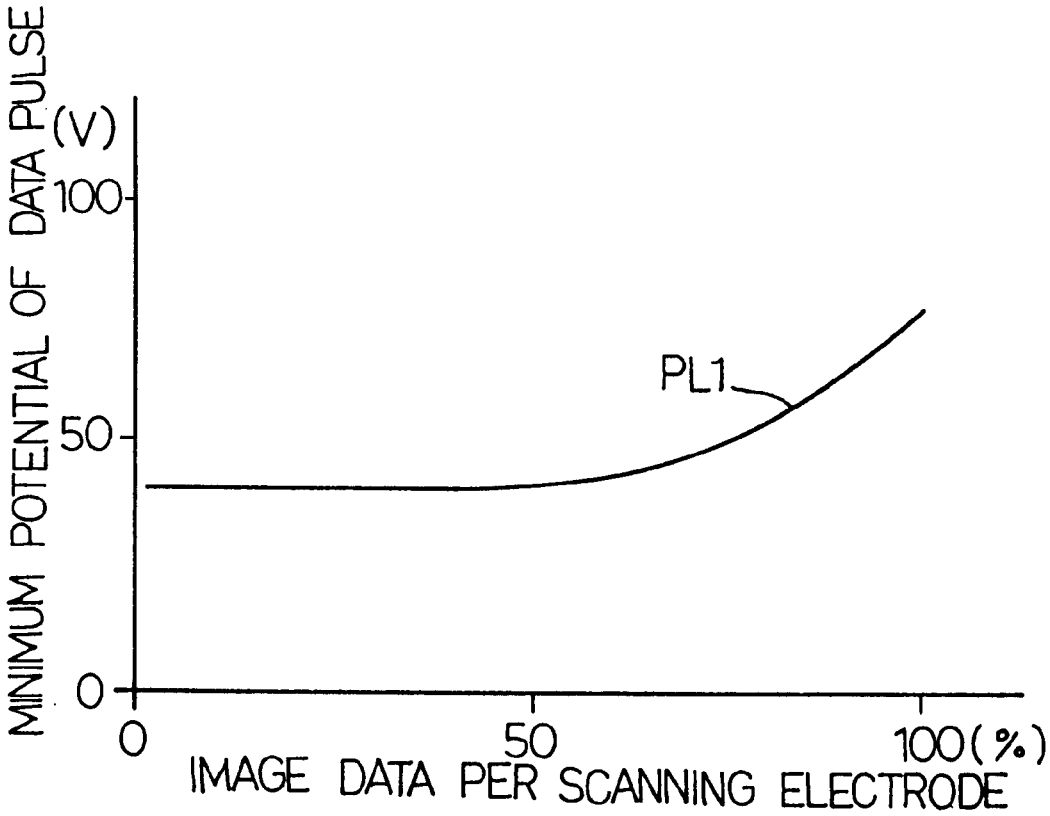
Fig. 4 PRIOR ART
FIG. 4 is a graph showing the minimum potential of the data pulse in terms of the pixels to be fired along each scanning line.
Figure 5:
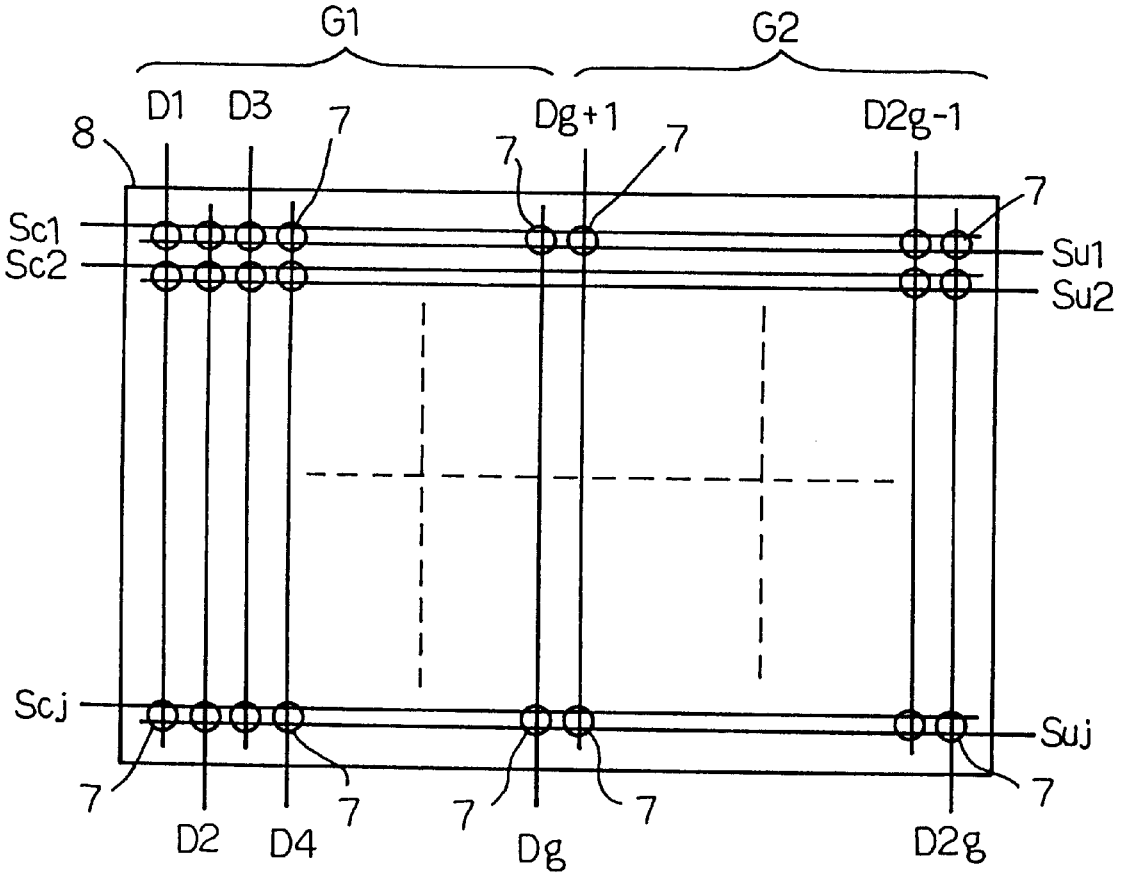
Fig. 5 PRIOR ART
FIG. 5 is a plan view showing the layout of the pixels and the electrodes incorporated in the prior art pulse memory driving type alternating current plasma display panel.
Figure 6:
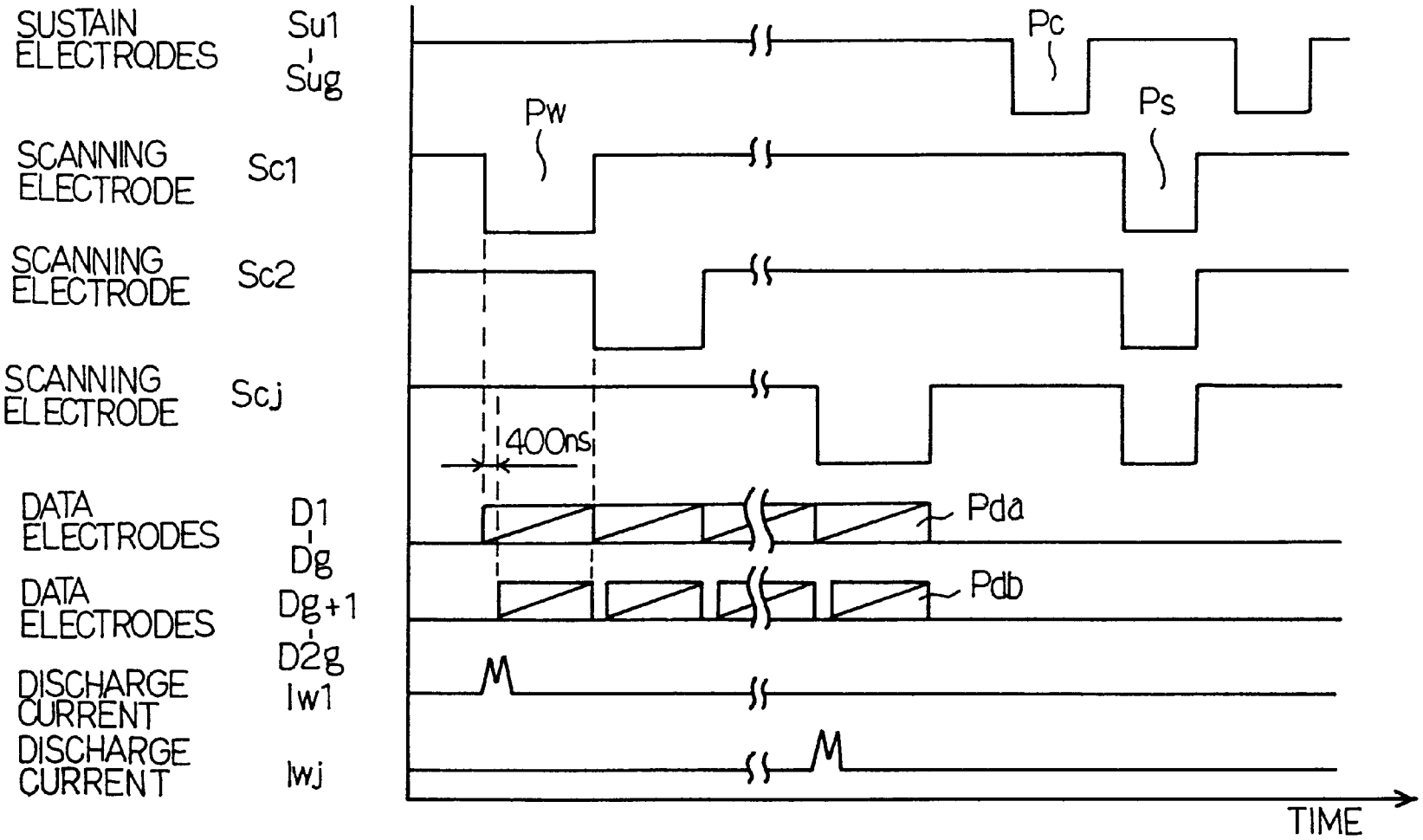
Fig. 6 PRIOR ART
FIG. 6 is a timing chart showing the prior art method for controlling the alternating current plasma display panel.
Figure 7:
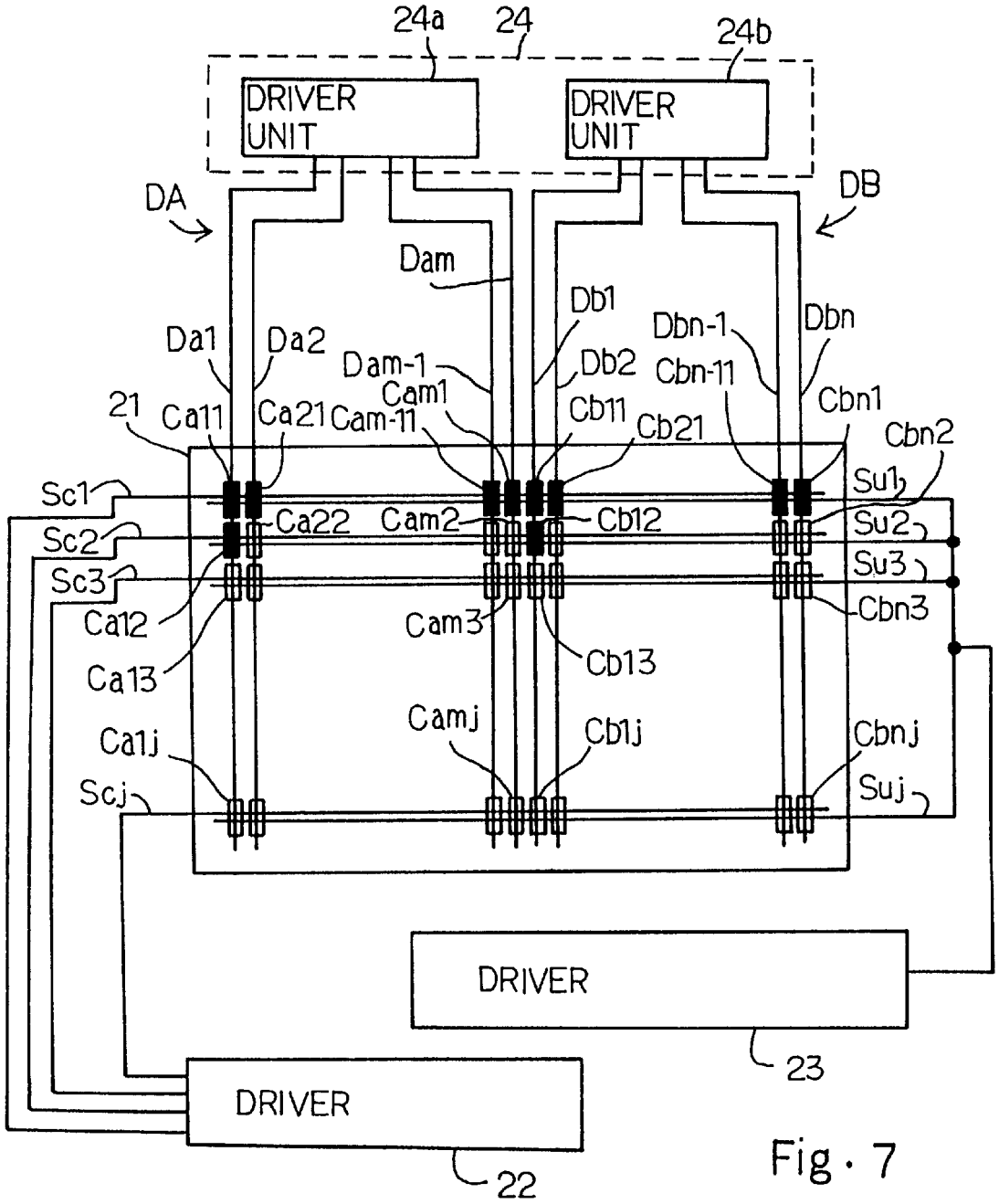
FIG. 7 is a schematic view showing a pulse memory driving type alternating current plasma display panel according to the present invention.

Referring to FIG. 7 illustrates a pulse memory driving type alternating current plasma display panel embodying the present invention. The plasma display panel comprises a display area 21 for producing a picture, scanning electrodes Sc1 to Scj, sustain electrodes Su1 to Suj and data electrodes Da1 to Dam and Db1 to Dbn. The display area 21 is implemented by an array of pixels Ca11/Ca12 and Cb11/Cb12. The rows of pixels Ca11–Cam1–Cb11–Cbn1/Ca12–Cam2–Cb12–Cbn2/Ca13–Cam13–Cam3–Cb13–Cbn3/ . . . /Caj1–Camj–Cb1j–Cbnj are respectively associated with the scanning electrodes Sc1 to Scj, and are further associated with the sustain electrodes Su1 to Suj, respectively. On the other hand, the columns of pixels Ca11–Ca1j/.../Cam1–CamjandCb11–Cb1j/.../Cbn1–Cbnjare respectively associated with the data electrodes Da1 to Dam and Db1 to Dbn. The structure of each pixel Ca11 to Cbnj is similar to the pixel 1, and no further description is incorporated hereinbelow for the sake of simplicity.

The plasma display panel further comprises a driver 22 for sequentially driving the scanning electrodes Sc1 to Scj, a driver 23 for concurrently driving the sustain electrodes Su1 to Suj and a driver 24 for selectively driving the data electrodes Da1 to Dam and Db1 to Dbn. The driver 24 includes two driver units 24*a* and 24*b*, and the data electrodes Da1 to Dam and the data electrodes Db1 to Dbn are connected to the driver units 24*a* and 24*b*, respectively. Thus, the data electrodes Da1 to Dam and the data electrodes Db1 to Dbn are divided into two data electrode groups DA and DB.

Figure 8:
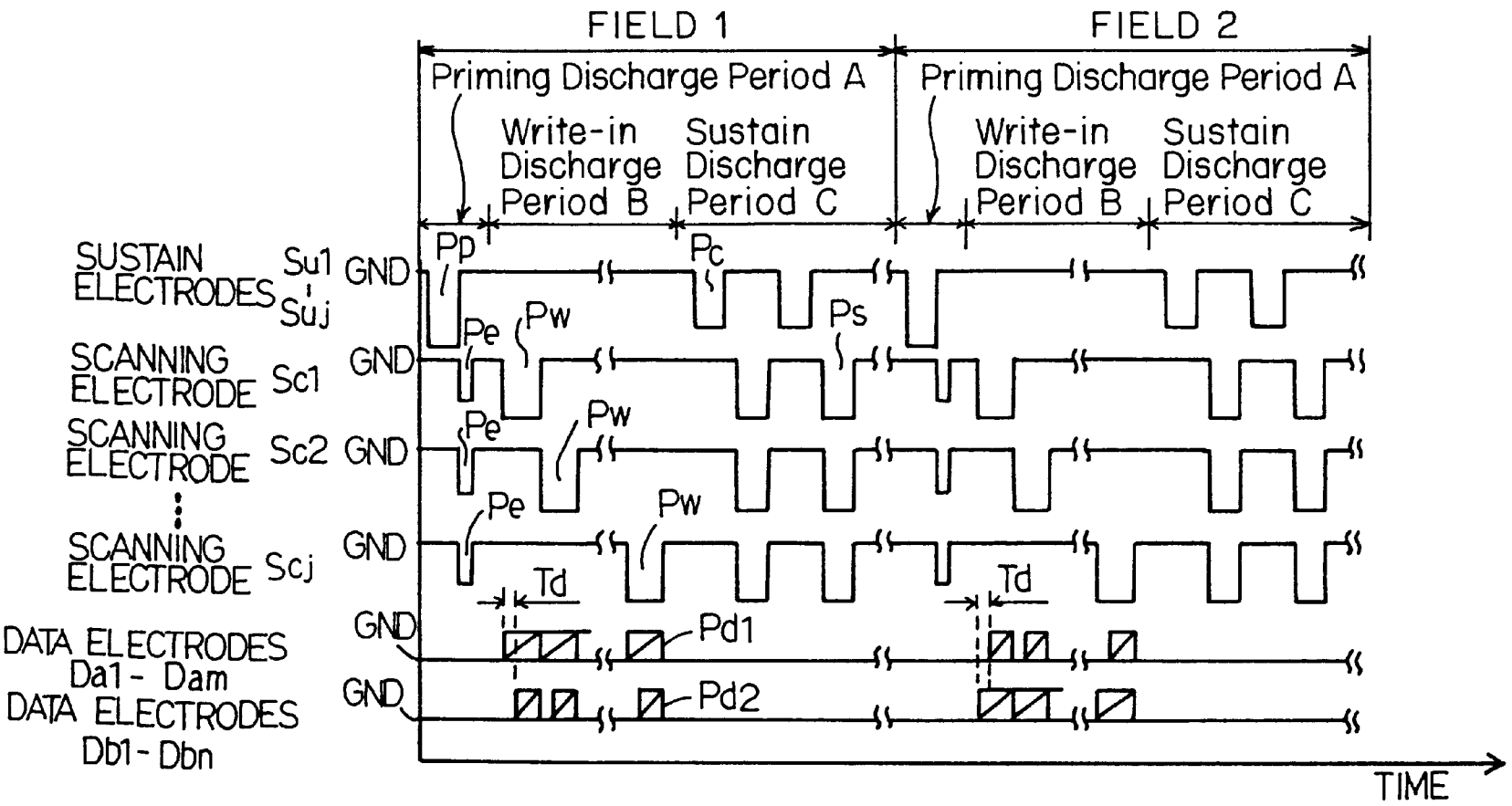
FIG. 8 is a timing charge showing a method for controlling the pulse memory driving type alternating current plasma display panel according to the present invention.

FIG. 8 illustrates a method for controlling the plasma display panel according to the present invention. The drivers 22/23/24 produce a picture on the display area 21, and field 1 and field 2 form each driving cycle or a frame. Each field is divided into a priming discharge period A, a write-in discharge period B and a sustain discharge period C.

The drivers 23 and 22 supply a priming discharge pulse Pp and an erasing pulse Pe to the sustain electrodes Su1 to Suj and the scanning electrodes Sc1 to Scj in the priming discharge period A. The priming pulse Pp gives rise to priming discharge in the pixels Ca11 to Cbnj so as to accumulate wall charges, and the erasing pulse Pe erases the wall charge undesirable for the write-in discharge.

Subsequently, the driver 22 sequentially supplies a scanning pulse Pw to the scanning electrodes Sc1 to Scj, and the driver units 24*a*/24*b* selectively supply data pulses Pd1/Pd2 to the data electrodes Da1 to Dam and Db1 to Dbn so as to produce the wall potential in selected pixels through write-in discharge. Time delay Td is introduced between the data pulse Pd1 and the data pulse Pd2. In field 1, the driver 24*a* firstly raises the data pulse Pd1, and, thereafter, the driver 24*b* raises the data pulse Pd2. However, when the plasma display panel proceeds to field 2, the driver unit 24*b* firstly raises the data pulse Pd2, and, thereafter, the driver 24*a* raises the data pulse Pd1.

The plasma display panel proceeds to the sustain discharge period C. The driver 23 supplies a sustain pulse Pc to the sustain electrode Su1 to Suj, and the driver 22 supplies a sustain pulse Ps to the scanning electrodes Sc1 to Scj. The sustain pulse Ps is different from the sustain pulse Pc at 180 degrees, and the sustain pulses Pc and Ps maintain the discharge in the selected pixels. Thus, the pixels Ca11 to Cbnj are selectively fired so as to produce a picture on the display area 21.

Figure 9:
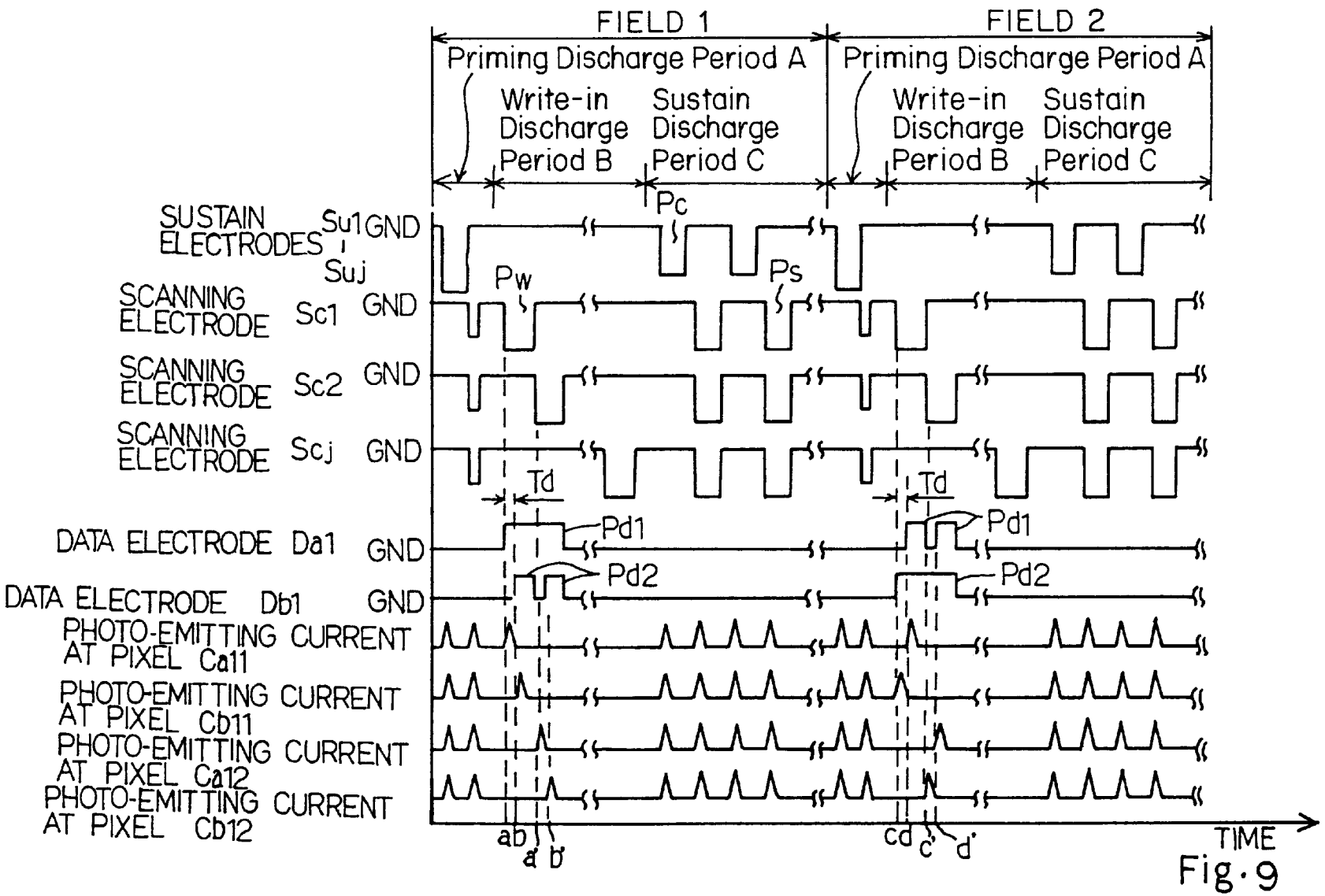
FIG. 9 is a timing chart showing a control sequence for selectively firing pixels.

In order to fire the pixels represented by black boxes in FIG. 7, the drivers 22/23/24 controls the sustain electrodes Su1–Suj, the scanning electrodes Sc1–Scj and the data electrodes Da1–Dam and Db1–Dbn as shown in FIG. 9. Description is focused on the photo-emitting current at the pixels Ca11, Ca12, Cb11 and Cb12.

The photo-emitting current flows at the pixels Ca11, Ca12, Cb11 and Cb12 in the priming discharge period A of the field 1. While the scanning pulse Pw on the scanning electrode Sc1 is staying in the active low level on the scanning electrode Sc1, the data pulse Pd1 on the data electrode Da1 rises at time a so that the write-in discharge takes place at the pixel Ca11, and the data pulse Pd12 on the data electrode Db1 rises at time b so that the write-in discharge takes place at the pixel Cb11. The timing b is delayed from the timing a by Td.

The scanning pulse Pw on the scanning electrode Sc2 is recovered to the ground level, and the scanning pulse Pw on the next scanning electrode Sc2 goes down from the ground level. The driver unit 24*a* continuously supplies the data pulse Pd1 to the data line Da1, and the write-in discharge takes place in the pixel Ca12 at time a'. The data pulse Pd2 is recovered to the ground level, and rises at time b', again, so as to fire the pixel Cb12. In this way, the selected pixels are sequentially fired in the write-in discharge period B of the field 1. The sustain pulses Pc/Ps cause the selected pixels to continuously fire in the sustain discharge period C of the field 1.

The duty factor is exchanged between the data pulse Pd1 and the data pulse Pd2. The photo-emitting current also flows at the pixels Ca21, Ca12, Cb11 and Cb12 in the priming discharge period A of the field 2. While the scanning pulse Pw on the scanning electrode Sc1 is staying in the active low level on the scanning electrode Sc1, the data pulse Pd2 on the data electrode Db1 rises at time c so that the write-in discharge takes place at the pixel Cb11, and the data pulse Pd1 on the data electrode Da1 rises at time d so that the write-in discharge takes place at the pixel Ca11. The timing d is delayed from the timing c by Td.

The scanning pulse Pw on the scanning electrode Sc1 is recovered to the ground level, and the scanning pulse Pw on the next scanning electrode Sc2 goes down from the ground level. The driver unit 24*b* continuously supplies the data pulse Pd1 to the data line Db1, and the write-in discharge takes place in the pixel Cb12 at time c'. The data pulse Pd1 is recovered to the ground level, and rises at time d', again, so as to fire the pixel Ca12. In this way, the selected pixels are sequentially fired in the write-in discharge period B of the field 2. The sustain pulses Pc/Ps cause the selected pixels to continuously fire in the sustain discharge period C of the field 2.

As will be appreciated from the foregoing description, the time delay Td is introduced between the data pulse Pd1 and the data pulse Pd2, and the peak value of the photo-emitting current is decreased rather than the peak value of the photo-emitting current of the prior art plasma display panel. Moreover, the duty factor is exchanged between the data pulse Pd1 and the data pulse Pd2 so as to equalize the load between the driver unit 24*a* and the driver unit 24*b*.

SECOND EMBODIMENT

Figure 10:
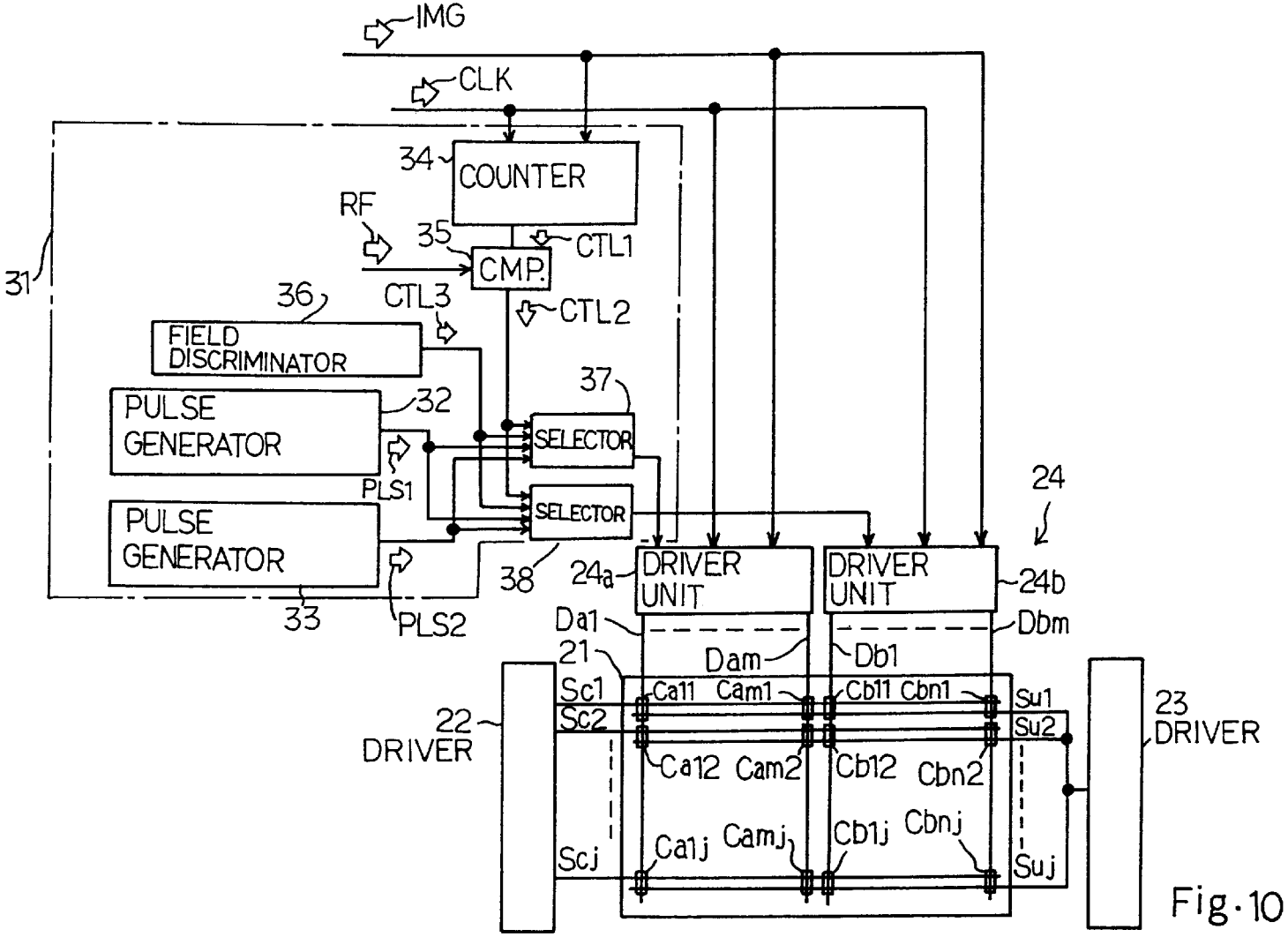
FIG. 10 is a schematic view showing another pulse memory driving type alternating current plasma display panel according to the present invention.

FIG. 10 illustrates another pulse memory driving type alternating current plasma display panel embodying the present invention. In this instance, a controller 31 is incorporated in the plasma display panel. The other components are similar to those of the first embodiment, and are labeled with the same references designating corresponding components of the first embodiment without detailed description.

The controller 31 includes two pulse generators 32 and 33. The pulse generator 32 generates a first pulse signal PLS1 and a second pulse signal PLS2, and the first pulse signal PLS1 and the second pulse signal PLS2 are different in duty factor from one another. The first pulse signal PLS1 has a pulse width equal to the scanning period, and the second pulse signal PLS2 is delayed from the first pulse signal PLS1. Data pulses Pd11 and Pd12 are produced from the first pulse signal PLS1 and the second pulse signal PLS2 as will be described hereinlater.

The controller 31 further includes a counter 34 and a comparator 35. A data clock signal CLK and an image data signal IMG are supplied to the counter 34, and determines the number of pixels to be fired for each scanning electrode Sc1–Scj. The counter 34 produces a control data signal CLT1 representative of the number of pixels to be fired, and supplied the control data signal CLT to the comparator 35. A reference signal RF is representative of the maximum number of pixels fired under a low write-in potential level, and is supplied to the comparator 35. The comparator 35 compares the number of pixels to be fired with the maximum number of pixels to see whether or not the pixels to be fired are greater than the maximum number. The comparator 35 produces a control data signal CLT2 representative of the comparison result.

The controller 31 further includes a field discriminator 36 and selectors 37/38. In this instance, the data pulse Pd11 is as wide in pulse width as the scanning period in every field 1, and is delayed from the data pulse Pd12 in every field 2. On the other hand, the data pulse Pd12 is delayed from the data pulse Pd11 in field 1, and is as wide in pulse width as the scanning period in every field 2. The field discriminator 36 determines a current field to be field 1 or field 2, and produces a control data signal CTL3 representative of the current field. The selectors 37/38 are connected to the driver units 24*a*/24*b*, respectively, and are responsive to the control data signals CTL2/CTL3 so as to selectively supply the first pulse signal PLS1 and the second pulse signal PLS2 to the driver units 24*a*/24*b*.

The image data signal IMG, the data clock signal CLK and first/second pulse signals PLS1/PLS2 are supplied to the driver units 24*a*/24*b*, and the driver units 24*a*/24*b* produces the data pulses Pd11/Pd12 so as to selectively supply the data pulses Pd11/Pd12 to the associated data electrodes Da1–Dam and Db1–Dbn.

If the number of pixels to be fired is greater than the maximum number, the selectors 37/38 respectively supply the first pulse signal PLS1 and the second pulse signal PLS2 to the driver units 24*a*/24*b* in field 1, and the second pulse signal PLS2 and the first pulse signal PLS1 to the driver units 24*a*/24*b* in field 2. However, when the number of pixels to be fired is equal to or less than the maximum number, the selectors 37/38 supply the first pulse signal PLS1 to the driver units 24*a*/24*b* in every field.

Figure 11:
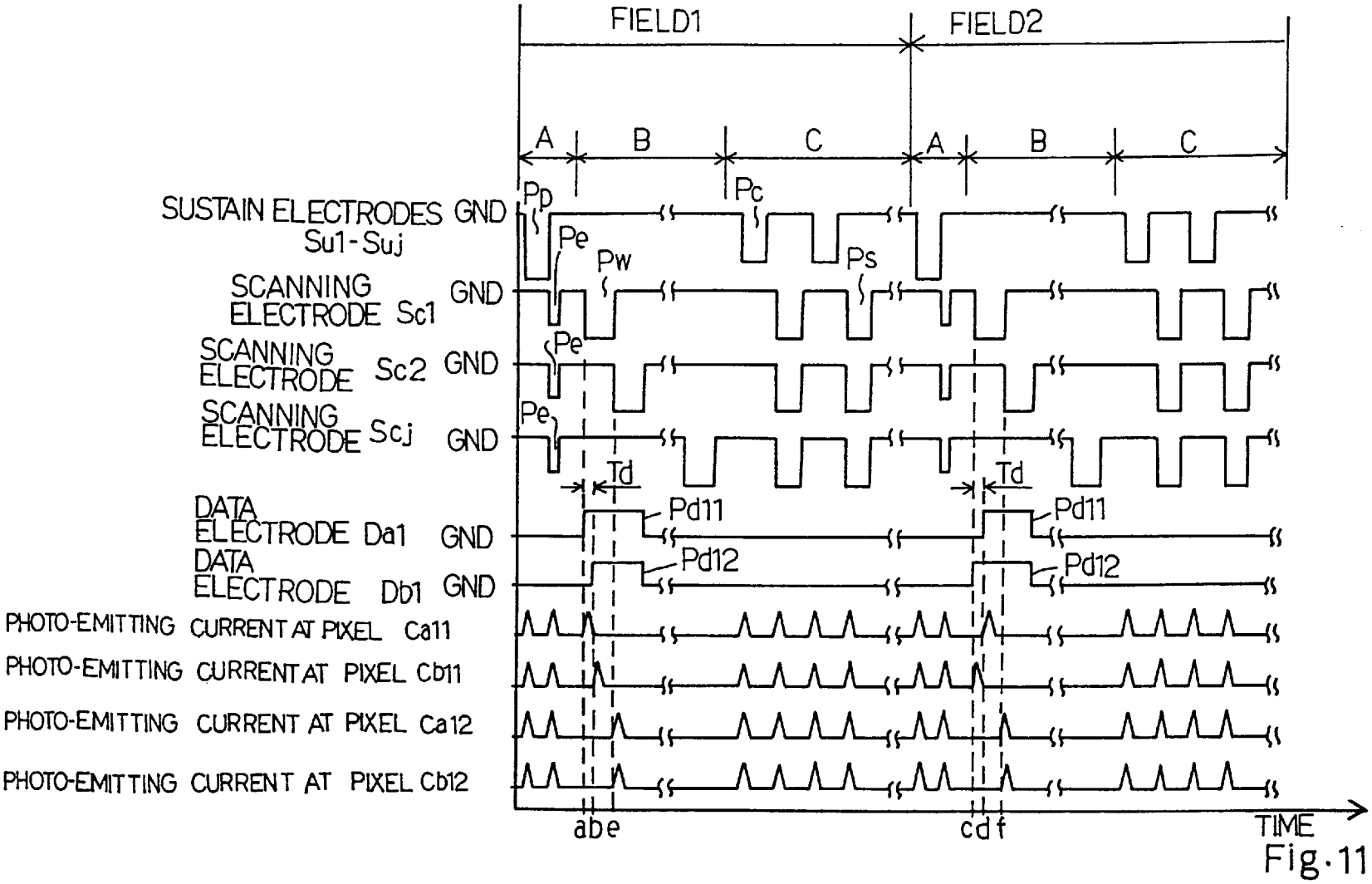
FIG. 11 is a timing chart showing a method for controlling the pulse memory driving type alternating current plasma display panel according to the present invention.

FIG. 11 illustrates another method for controlling the plasma display panel according to the present invention. The priming discharge period A and the sustain discharge period C are similar to those of the first embodiment, and description is focused on the write-in discharge period B. The pixels indicated by black boxes in FIG. 7 are assumed to be fired. The number of pixels to be fired on the scanning electrode Sc1 is greater than the maximum number, and the number of pixels to be fired on the scanning electrode Sc2 is less than the maximum number.

The scanning pulse Pw on the scanning electrode Sc1 goes down at time a, and the data pulse Pd11 on the data line Da1 rises at the same timing. Then, the write-in discharge takes place at the pixel Ca11. The data pulse Pd12 on the data electrode Db1 rises at time b, and the pixel Cb11 is fired. Time delay Td is introduced between the data pulse Pd11 and the data pulse Pd12.

The first pulse signal PLS1 is supplied to both driver units 24*a*/24*b*, and the driver units 24*a*/24*b* supplies the data pulses Pd11 and Pd12 as wide as the scanning pulse Pw to the data lines Da1/Db2 without fall to the ground level. The scanning pulse Pw on the scanning electrode Sc2 goes down at time e, and the pixels Ca12 and Cb12 are concurrently fired.

The plasma display panel proceeds to field 2. The scanning pulse Pw on the scanning electrode Sc2 goes down at time c, and the data pulse Pd12 on the data line Db1 rises at the same timing. Then, the write-in discharge takes place at the pixel Cb11. The data pulse Pd11 on the data electrode Da1 rises at time d, and the pixel Ca11 is fired. Time delay Td is also introduced between the data pulse Pd11 and the data pulse Pd12. However, the data pulse Pd12 rises earlier than the data pulse Pd11.

The first pulse signal PLS1 is supplied to both driver units 24*a*/24*b*, and the driver units 24*a*/24*b* supplies the data pulses Pd11 and Pd12 as wide as the scanning pulse Pw to the data lines Da2/Db2 without fall to the ground level. The scanning pulse Pw on the scanning electrode Sc2 goes down at time f, and the pixels Ca12 and Cb12 are concurrently fired as similar to field 1.

As will be understood from the foregoing description, the driver units 24*a*/24*b* selectively supplies the first pulse signal PLS1 and the second pulse signal PLS2 to the driver units 24*a*/24*b*, because the pixels to be fired are greater than the maximum number. However, the first/second pulse signals PLS1/PLS2 are exchanged between the driver units 24*a*/24*b*, and the load is equalized between the driver units 24*a* and 24*b*.

Moreover, when the pixels to be fired on the scanning electrode Sc2 is less than the maximum number, the data pulses Pd11/Pd12 are equal in width to the scanning pulse, and are not decayed to the ground level between the scanning electrodes Sc1 and Sc2. For this reason, the electric power consumption is reduced.

Although particular embodiments of the present invention have been shown and described, it will be obvious to those skilled in the art that various changes and modifications may be made without departing from the spirit and scope of the present invention.

For example, the data lines or the frame may be divided into more than two groups. In this instance, more than two data pulses are applied at different timings to the more than two groups, and duty factors are exchanged between the more than two data pulses.

Each field may be divided into a plurality of sub-fields so as to grade the luminance into $Y \times 2^z$ where Y is a constant and z is not less than zero and different between the sub-fields. The data pulses may be exchanged between the sub-fields.

The odd electrodes and the even electrodes may form the data electrode groups DA and DB.

What is claimed is:

1. A method for controlling a plasma display panel having a plurality of scanning electrodes, a plurality of sustain electrodes respectively paired with said plurality of scanning electrodes for forming a plurality of electrode pairs, a plurality of data electrodes divided into a plurality of data electrode groups and a plurality of pixels selectively associated with said plurality of electrode pairs and said plurality of data electrodes and selectively fired for forming an image, comprising the steps of:

a) supplying a scanning pulse and a plurality of data pulses different in duty factor and delayed from one another sequentially to said scanning electrodes and selectively to said plurality of data electrodes of said plurality of data electrode groups in a first phase of a certain field, respectively, for selectively generating a write-in discharge in said plurality of pixels;

b) supplying a first sustain pulse and a second sustain pulse different in phase from said first sustain pulse to said plurality of scanning electrodes and said plurality of sustain electrodes in a second phase of said certain field for keeping said first certain pixels fired;

c) supplying said scanning pulse and said plurality of data pulses changed in duty factor from said plurality of data pulses in said step a) sequentially to said scanning electrodes and selectively to said plurality of data electrodes of said plurality of data electrode groups in said first phase of another field, respectively, for selectively generating said write-in discharge in said plurality of pixels; and d) supplying said first sustain pulse and said second sustain pulse to said plurality of scanning electrodes and said plurality of sustain electrodes in said second phase of said another field for keeping said second certain pixels fired.

2. The method as set forth in claim 1, in which one of said plurality of data pulses in said step a) and another of said plurality of data pulses in said step c) are equal in pulse width to said scanning pulse, and said another of said plurality of data pulses in said step a) and said one of said plurality of data pulses in said step c) are smaller in pulse width than said one of said plurality of data pulses in said step a) and said another of said plurality of data pulses in said step c) and delayed therefrom.

3. The method as set forth in claim 1, further comprising the step of supplying a priming discharge pulse and an erasing pulse to said plurality of sustain electrodes and said plurality of scanning electrodes so as to produce a wall potential before said step a) and between said step b) and said step c).

4. The method as set forth in claim 3, in which one of said plurality of data pulses in said step a) and another of said plurality of data pulses in said step c) are equal in pulse width to said scanning pulse, and said another of said plurality of data pulses in said step a) and said one of said plurality of data pulses in said step c) are smaller in pulse width than said one of said plurality of data pulses in said step a) and said another of said plurality of data pulses in said step c) and delayed therefrom.

5. The method as set forth in claim 1, further comprising the step of determining the number of pixels to be fired on each scanning electrode whether to be greater than a predetermined number or not before step a), and said predetermined number is indicative of the maximum number of pixels fired under a low potential level of a data pulse.

6. The method as set forth in claim 5, in which said plurality of data electrodes are supplied with a data pulse equal in which to said scanning pulse instead of said plurality of data pulses in said steps a) and c) when said number of pixels to be fired is equal to or less than said predetermined number.

* * * * *